US010281842B2

(12) United States Patent
Huang

(10) Patent No.: US 10,281,842 B2
(45) Date of Patent: May 7, 2019

(54) TONER CARTRIDGE

(71) Applicant: GENERAL PLASTIC INDUSTRIAL CO., LTD., Taichung (TW)

(72) Inventor: Ching-Ho Huang, Taichung (TW)

(73) Assignee: GENERAL PLASTIC INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 15/793,302

(22) Filed: Oct. 25, 2017

(65) Prior Publication Data

US 2018/0356750 A1 Dec. 13, 2018

(30) Foreign Application Priority Data

Jun. 7, 2017 (TW) ..... 106118868 A

(51) Int. Cl.
*G03G 15/08* (2006.01)
*G03G 21/16* (2006.01)

(52) U.S. Cl.
CPC ..... *G03G 15/0886* (2013.01); *G03G 15/087* (2013.01); *G03G 15/0865* (2013.01); *G03G 21/1647* (2013.01)

(58) Field of Classification Search
CPC ..... G03G 15/0865; G03G 15/0867; G03G 21/1676; G03G 15/0872; G03G 15/0886
USPC ..... 399/262
See application file for complete search history.

(56) References Cited

U.S. PATENT DOCUMENTS 6,256,470 B1 * 7/2001 Taniyama ..... G03G 15/0868 222/DIG. 1
7,680,444 B2 * 3/2010 Kaiho ..... G03G 15/0872 399/260
2012/0321341 A1 * 12/2012 Hori ..... G03G 15/0881 399/110
2014/0270859 A1 * 9/2014 Hosokawa ..... G03G 15/0872 399/262

* cited by examiner

*Primary Examiner* — Walter L Lindsay, Jr.
*Assistant Examiner* — Frederick Wendeoth
(74) *Attorney, Agent, or Firm* — Muncy, Geissler, Olds & Lowe, P.C.

(57) ABSTRACT

A toner cartridge includes a housing having a toner exit and two coupling portions, a slide piece disposed to the housing and slidably moveable between opened and sealed positions, a sealing member disposed to the slide piece in a way that the sealing member blocks the toner exit when the slide piece stays at the sealed position, and a clamping cover having an abutment portion, and two coupling arms extending upwardly from two lateral sides of the abutment portion and engaged with the two coupling portions, respectively. The abutment portion is abutted against the slide piece that stays at the sealed position in a way that the sealing member is compressed and deformed. As such, the sealing member can positively block the toner exit, and the slide piece can smoothly move between the opened and sealed positions after the clamping cover is removed.

11 Claims, 7 Drawing Sheets

TONER CARTRIDGE

BACKGROUND OF THE INVENTION

1. Field of the Invention

The present invention relates generally to a device used in an image-forming apparatus and more particularly, to a toner cartridge used in an image-forming apparatus.

2. Description of the Related Art

A conventional toner cartridge is generally composed of a cap having a toner exit for discharging toner, a slide piece slidably disposed to the cap, and a foam member attached to the slide piece. When the slide piece slides to a position corresponding to the toner exit, the foam member can block the toner exit to prevent the toner from leaking out. However, if the foam member has an insufficient thickness, a gap may easily exist between the foam member and the toner exit due to the fact that the foam member may not be firmly pressed on the toner exit, resulting in that toner may leak from the gap. If the foam member is provided with an exceeding thickness so that the toner exit can be positively blocked, the drag occurred when the slide piece slides may increase and the edge of the foam member may be tilted or peeled up by the edge of the toner exit when the slide piece slides and the edge of the foam member is in contact with the edge of the toner exit. This may cause deformation or break of the foam member, such that the foam member may no longer be able to completely block the toner exit, resulting in toner leaking eventually. Further, in actual manufacturing process, the made elements may have various tolerances in sizes and the foam member may not be always made with optimal thickness. Therefore, how to positively block the toner exit without increasing the sliding drag of the slide piece has become an issue to be solved by the manufacturers.

SUMMARY OF THE INVENTION

The present invention has been accomplished in view of the above-noted circumstances. It is an objective of the present invention to provide a toner cartridge having a slide piece capable of positively sealing a toner exit and having a small sliding drag when the slide piece slides.

To attain the above objective, the present invention provides a toner cartridge comprising a housing, a slide piece, a sealing member, and a clamping cover. The housing has a bottom side with a toner exit, and two lateral sides with two coupling portions. The slide piece is disposed to the housing and slidably moveable between an opened position and a sealed position. The sealing member is disposed to the slide piece in a way that the sealing member blocks the toner exit when the slide piece stays at the sealed position. The clamping cover has an abutment portion, and two coupling arms extending upwardly from two lateral sides of the abutment portion and engaged with the two coupling portions of the housing, respectively. The abutment portion of the clamping cover is abutted against the slide piece that stays at the sealed position in a way that the sealing member is compressed and deformed.

As such, when the slide piece stays at the sealed position, the sealing member can positively block the toner exit to prevent toner leakage. In the other hand, when the clamping cover is removed, the slide piece can smoothly slide between the opened position and the sealed position.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
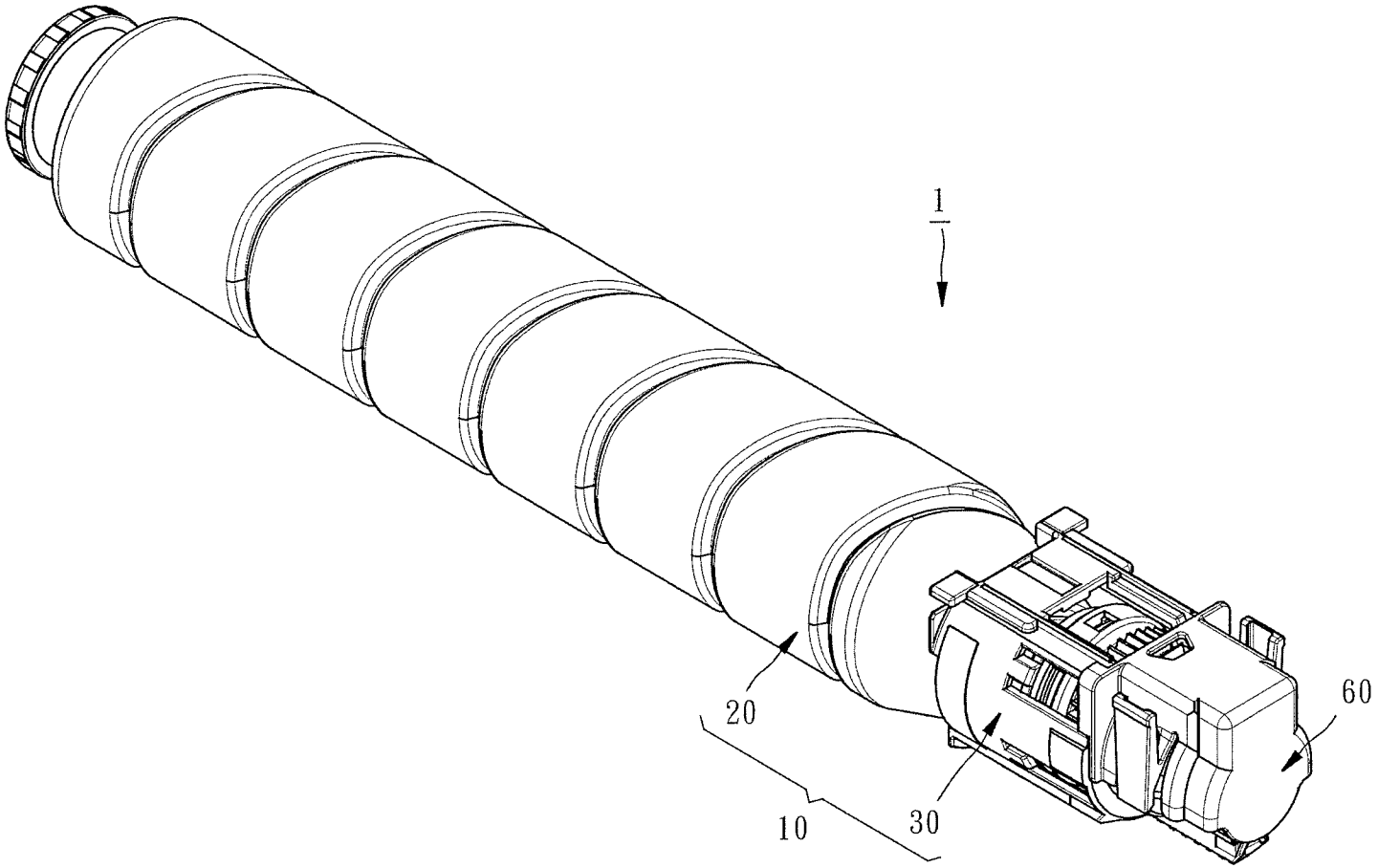
FIG. 1 is a perspective view of a toner cartridge according to a preferred embodiment of the present invention.
Figure 2:
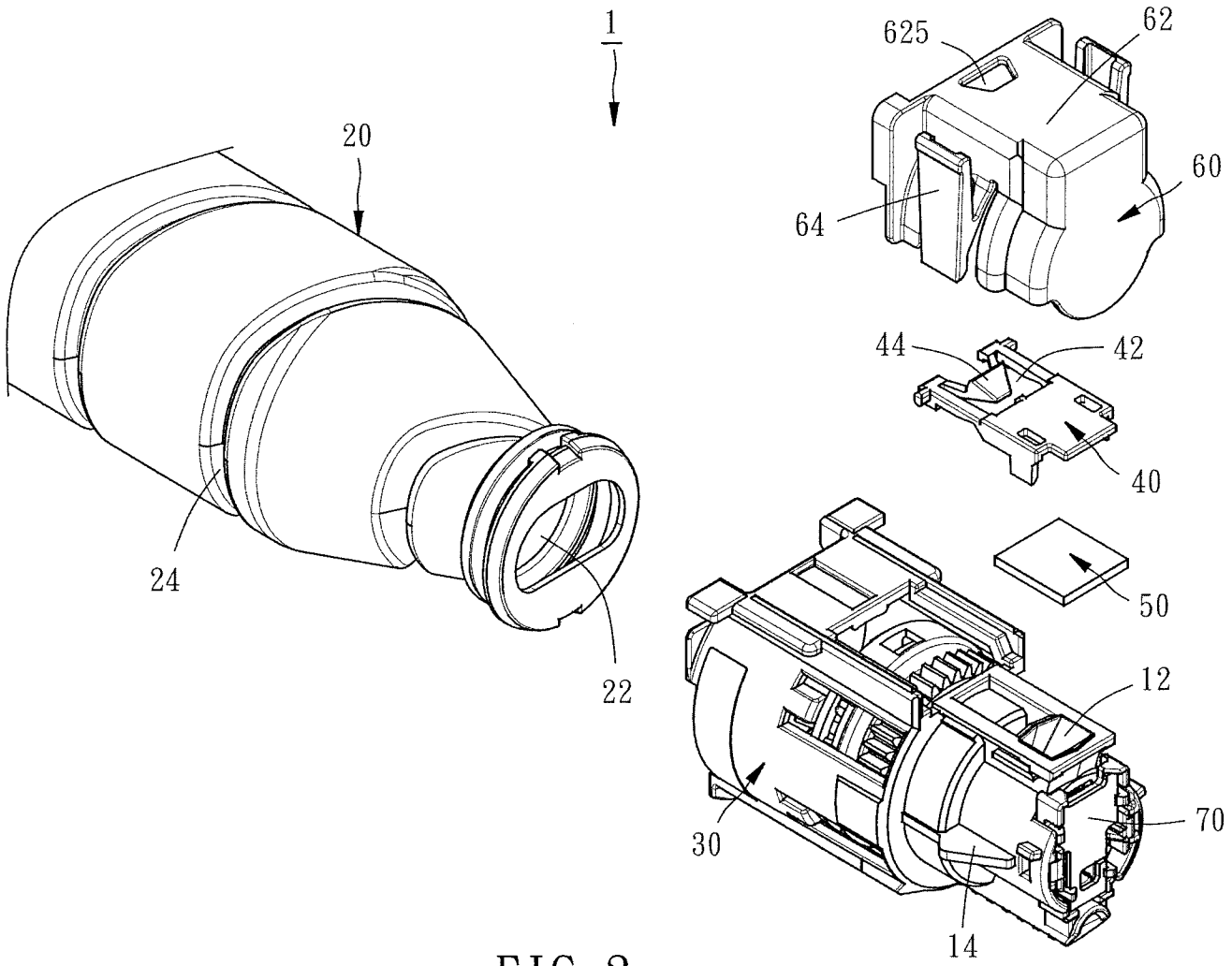
FIG. 2 is an exploded view of the toner cartridge of FIG. 1.

FIGS. 1 and 2 show a toner cartridge 1 in accordance with a preferred embodiment of the present invention. The toner cartridge 1 is composed of a housing 10, a slide piece 40, a sealing member 50, a clamping cover 60, and a control circuit board 70 disposed to a terminal end of the housing 10. It is to be noted that the toner cartridge 1 is depicted in FIGS. 1 and 2 in a way that the bottom side of the toner cartridge 1 faces upward and the top side of the toner cartridge 1 faces downward in FIGS. 1 and 2. Therefore, if a term "top side" of an element is used in the written description, the "top side" of the element will be depicted facing downward in the drawing. Similarly, the "bottom side" of an element will be depicted facing upward in the drawings.

The housing 10 is provided at a bottom side thereof with a toner exit 12, and at each of two lateral sides thereof with a plate-like protruding coupling portion 14. In this embodiment, the housing 10 is composed of a barrel 20 and an end cap 30 detachably and rotatably mounted to the barrel 12. The toner exit 12 of the housing 10 is provided at a bottom side of the end cap 30 and the two coupling portions 14 of the housing 10 are provided at two lateral sides of the end cap 30. In other feasible embodiments, the shape and structure of the two coupling portions 14 are not limited to the disclosure of this embodiment, and the barrel 20 and the end cap 30 can be formed as a unitary structure, which cannot be detached from each other.

The barrel 20 is provided at an end thereof with an opening 22 communicated with an inside of the barrel 20 and an outside of the barrel 20. The barrel 20 further includes a thread portion 24 inwardly recessed towards the inside accommodation of the barrel 20 on a part of the outer surface of the barrel 20. The aforesaid inside indicates the inside accommodation of the barrel 20, and the outside indicates the ambient space outside the barrel 20. The inside accommodation of the barrel 20 contains toner. During rotation of the barrel 20, the toner contained in the inside accommodation of the barrel 20 will be conveyed by the rotary thread portion 24 toward the opening 22 of the barrel 20, and then pass through the opening 22, and eventually be discharged out of the housing 10 via the toner exit 12. In fact, many designs can achieve the goal of discharging toner out of the toner cartridge 1. The foregoing structure of discharging toner is just an exemplary embodiment, which is not to be used to limit the toner discharging structure of the barrel 20.

The end cap 30 is disposed to the end of the barrel 20 and blocks over the opening 22 of the barrel 20. The control circuit board 70 is disposed to a terminal end of the end cap 30. In other embodiments, the circuit board 70 can be mounted to another part of the toner cartridge 1 or can be omitted.

Figure 3:
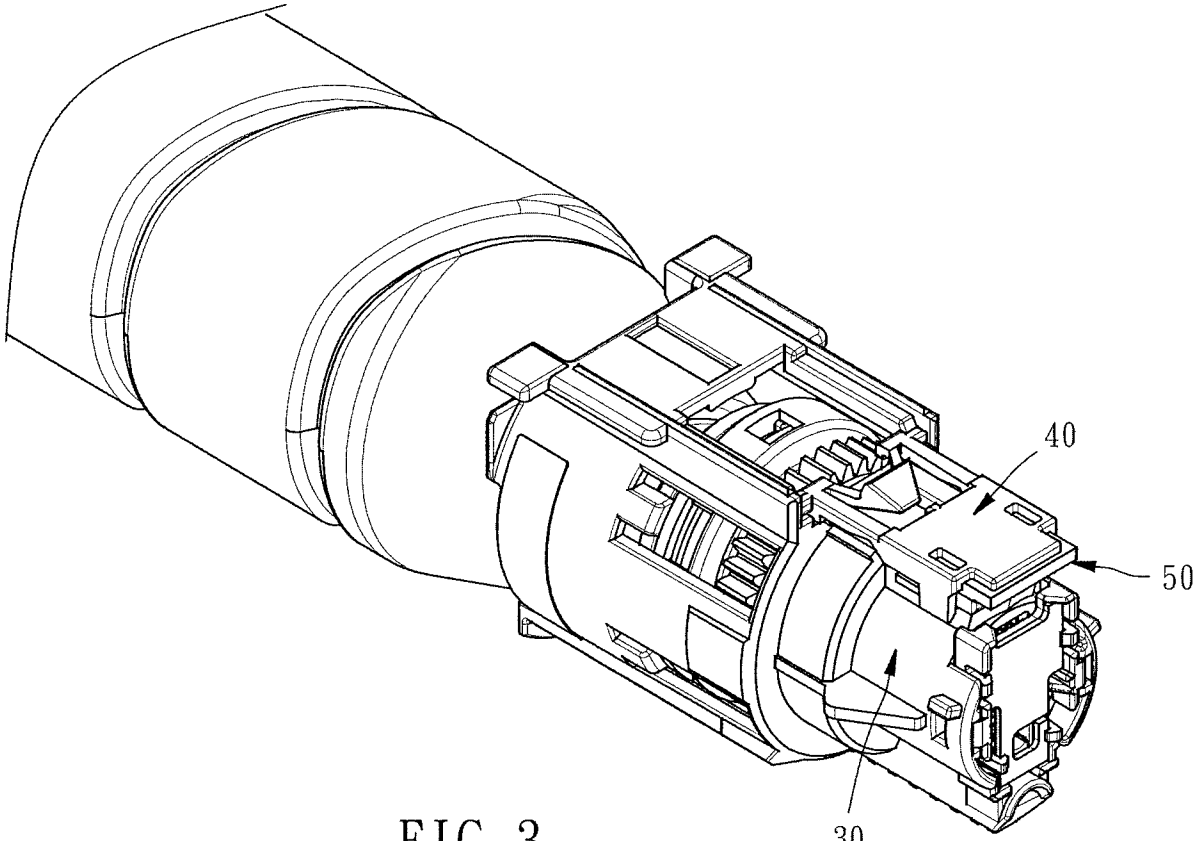
FIG. 3 is schematic perspective view of the toner cartridge according to the preferred embodiment of the present invention, showing that a slide piece stays at a sealed position.
Figure 4:
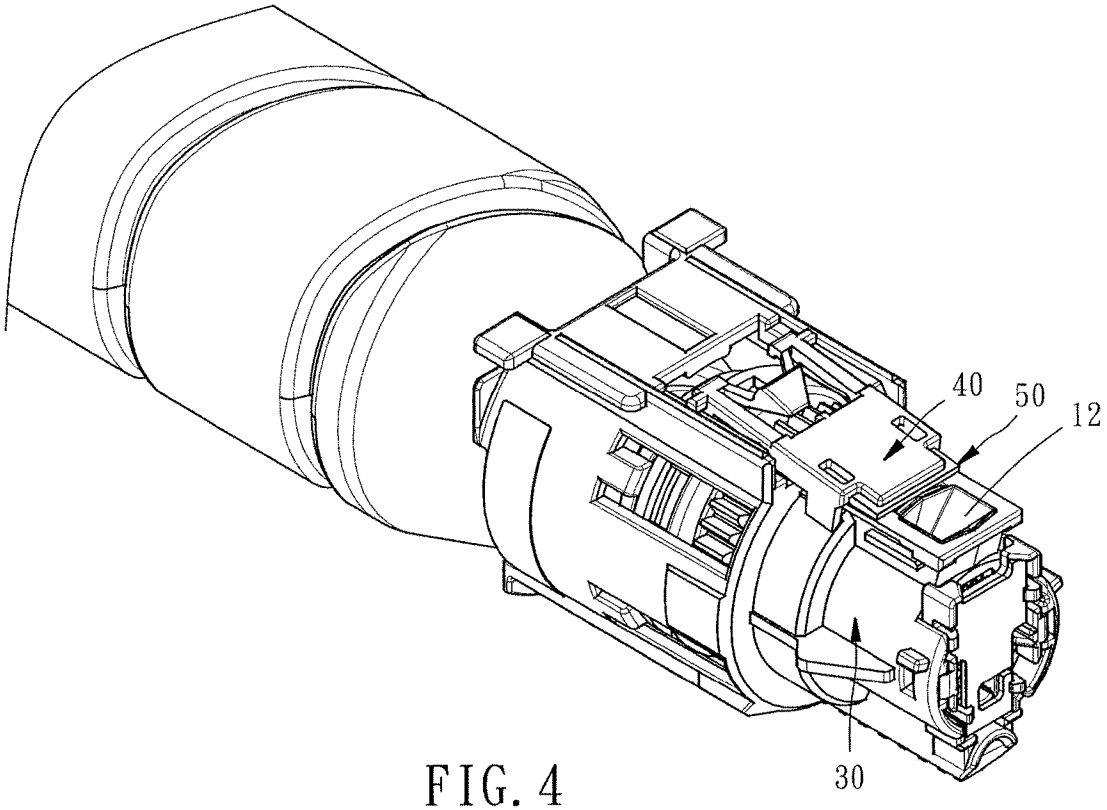
FIG. 4 is schematic perspective view of the toner cartridge according to the preferred embodiment of the present invention, showing that the slide piece stays at an opened position.

The slide piece 40 is disposed to the end cap 30 of the housing 10 and slidably moveable between a sealed position, as shown in FIG. 3, and an opened position, as shown in FIG. 4. The slide piece 40 has a hollow portion 42 and a protrusion portion 44 located by the hollow portion 42. In this embodiment, the protrusion portion 44 is pushable by a relevant element of an image-forming apparatus, such that the slide piece 40 can be driven to slide from the opened position to the sealed position. Another part of the slide piece 40 is pushable by a relevant element of the image-forming apparatus, such that the slide piece 40 can be driven to slide from the sealed position to the opened position. In other feasible embodiments, the structure of the slide piece 40 is not limited to the disclosure of this embodiment. In other words, a drive element of the image-forming apparatus can push another part of the slide piece 40 so as to achieve the goal of slidably moving the slide piece 40 between the sealed position and the opened position.

The sealing member 50 is disposed to the slide piece 40 in a way that the sealing member 50 blocks and seals the toner exit 12 when the slide piece 40 stays at the sealed position.

Figure 5:
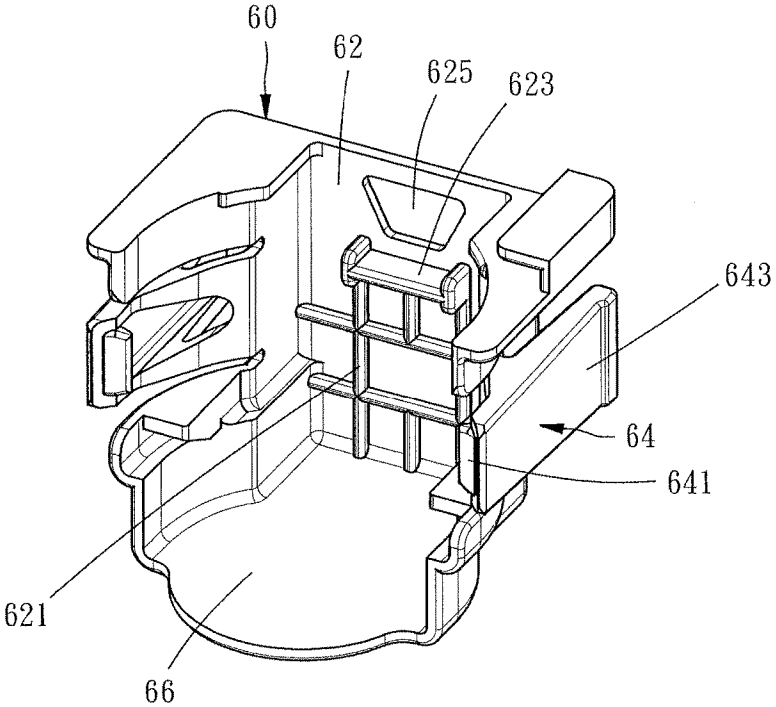
FIG. 5 is a perspective view of a clamping cover of the toner cartridge according to the preferred embodiment of the present invention.

Referring to FIGS. 2 and 5, the clamping cover 60 is depicted in FIG. 5 in a way that the bottom side of the clamping cover 60 faces upwards and the top side of the clamping cover 60 faces downwards. The clamping cover 60 has a plate-shaped abutment portion 62, two coupling arms 64 extending respectively and upwardly from two lateral sides of the abutment portion 62, and a guard plate 66 extending upwardly from a terminal end of the abutment portion 62. The guard plate 66 covers over the terminal end of the end cap 30 of the housing 10 and the control circuit board 70 that is disposed to the terminal end of the end cap 30 of the housing 10, such that the control circuit board 70 is well protected by the guard plate 66, thereby preventing the circuit board 70 from damage due to impact. The two coupling arms 64 are engageable with the two coupling portions 14 of the end cap 30 of the housing 10 respectively, such that the clamping cover 60 can be coupled to the end cap 30. In this embodiment, each coupling arm 64 is provided at a top end thereof with a hook 641 engageable with one of the coupling portions 14, and at an outer periphery thereof with an operating tab 643 extending downwardly. The abutment portion 62 of the clamping cover 60 is provided at a top side thereof with a plurality of ribs 621 pressing on the slide piece 40 and a positioning rib 623 extending into the hollow portion 42 of the slide piece 40 in a way that the positioning rib 623 of the clamping cover 60 may be or may not be abutted against a lateral side edge of the hollow portion 42 of the slide piece 40. The abutment portion 62 has a through hole 625, into which the protrusion portion 44 of the slide piece 40 extends. In a condition that the control circuit board 70 is not disposed to the terminal end of the end cap 30 but to another part of the toner cartridge 1, the guard 66 of the clamping cover 60 can be omitted accordingly.

Figure 6:
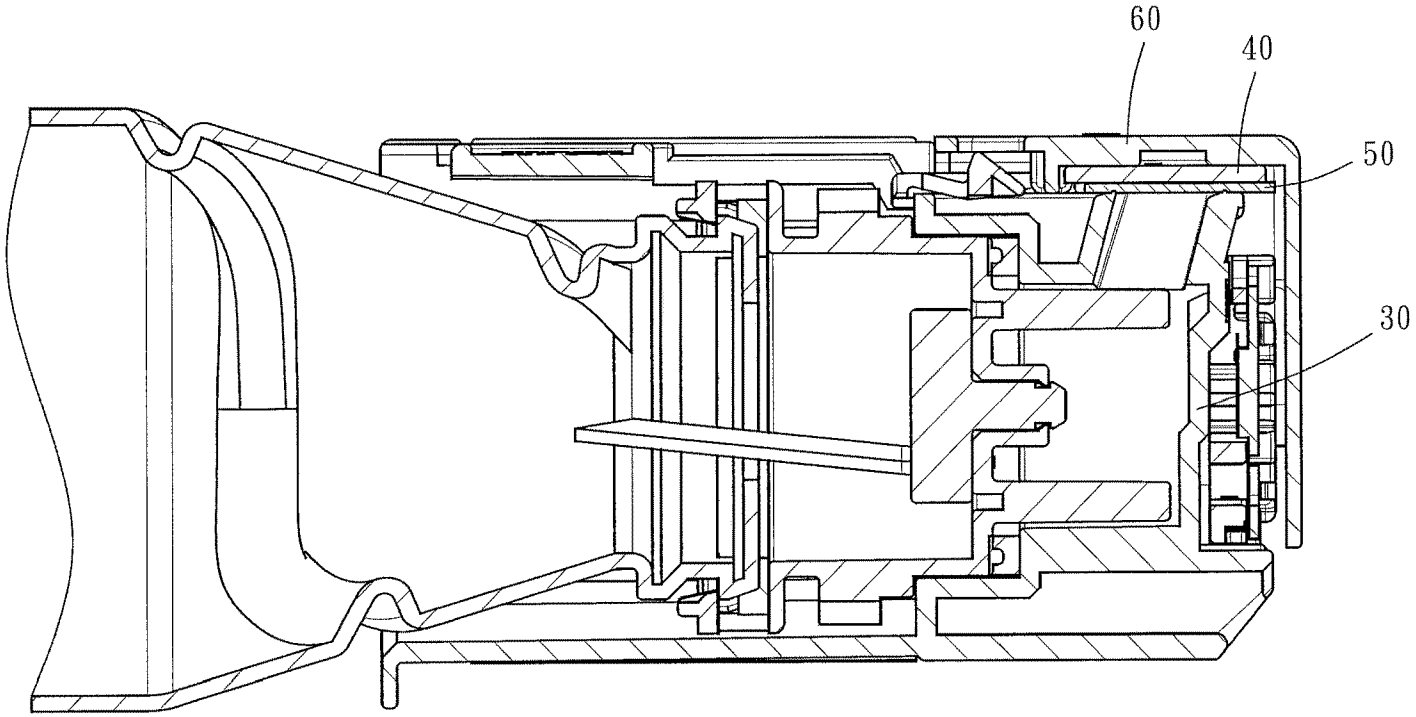
FIG. 6 is a sectional view of the toner cartridge according to the preferred embodiment of the present invention.

When the clamping cover 60 is coupled to the end cap 30, the two coupling arms 64 are engaged with the two coupling portions 14 of the end cap 30 of the housing 10, and the ribs 621 of the abutment portion 62 press on the slide piece 40 that stays at the sealed position to cause compression and deformation of the sealing member 50, as shown in FIG. 6. Under this circumstance, the sealing member 50 can positively block and seal the toner exit 12 so as to prevent the toner cartridge 1 from toner leakage. Further, because the protrusion portion 44 of the slide piece 40 extends into the through hole 625 of the abutment portion 62 and the positioning rib 623 extends into the hollow portion 42 of the slide piece 40 when the clamping cover 60 and the end cap 30 are coupled with each other, the slide piece 40 is prohibited from sliding from the sealed position to cause the toner exit 12 to become an opened manner from a sealed manner, thereby completely preventing the toner cartridge 1 from any possibility of toner leaking. In fact, the ribs 621 are provided to help the abutment portion 62 to press the slide piece 40 more authentically and positively. In other feasible embodiments, the ribs 621 can be omitted. In this case, the top side of the abutment portion 62 directly presses on the slide piece 40. Moreover, as long as the abutment portion 62 or the ribs 621 can positively press on the slide piece 40 to cause that the slide piece 40 won't easily slide when the clamping cover 60 and the end cap 30 are coupled together, the positioning rib 623 of the abutment 62 needs not to extend into the hollow portion 42 of the slide piece 40 or the positioning rib 623 and the hollow portion 42 may be omitted, and similarly the protrusion portion 44 of the slide piece 40 also needs not to extend into the through hole 625 of the abutment portion 62 or the protrusion portion 44 and the through hole 625 may be omitted. However, it is worth mentioning that in this embodiment, when the clamping cover 60 and the end cap 30 are well coupled together, the protrusion structure of the positioning rib 623 is used to extend into the hollow portion 42 and the protrusion structure of the protrusion portion 44 is used to extend into the through hole 625. Therefore, if the slide piece 40 is not completely located at the sealed position, when the clamping cover 60 is to be coupled to the end cap 30, the positioning rib 623 and the protrusion portion 44 will stop at unexpected parts of the slide piece 40 and the clamping cover 60, resulting in that the clamping cover 60 cannot be smoothly coupled to the end cap 30. This mechanism can alert a user or an assembling worker to the fact that the sealing member 50 does not completely cover over the toner exit 12 during the assembly work, and the slide piece 40 needs to be completely placed at the sealed position before the clamping cover 60 is coupled to the end cap 30 in order to prevent toner leakage.

Figure 7:
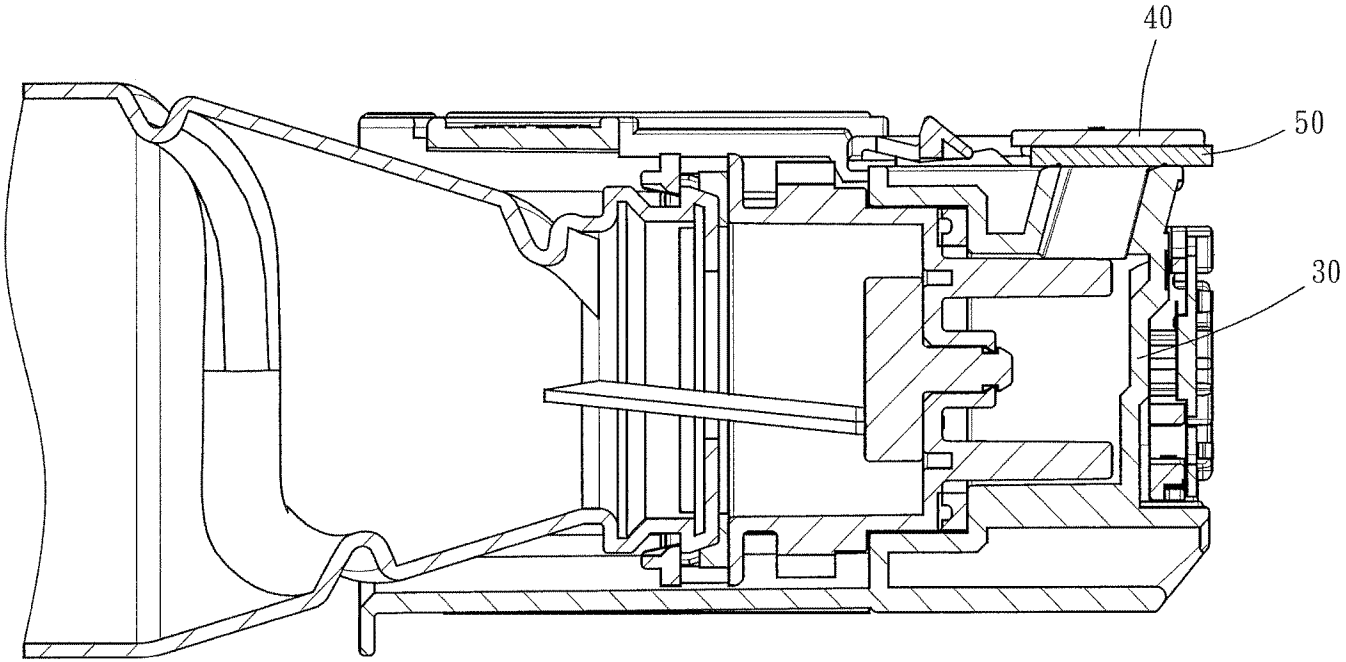
FIG. 7 is a sectional view of the toner cartridge of FIG. 6, in which the clamping cover is removed.

When a user wants to install the toner cartridge 1 to an image-forming apparatus, the clamping cover 60 needs to be dismantled from the end cap in advance. To this end, the user only needs to press the operating tabs 643 of the two coupling arms 64 of the clamping cover 60 inwardly to case that the hooks 641 at the top ends of the coupling arms 64 are disengaged from the coupling portions 14, such that the clamping cover 60 can be easily dismantled from the end cap 30. This dismantling procedure can be easily and conveniently operated. After the clamping cover 60 is dismantled from the end cap 30, the slide piece 40 is no longer pressed by the ribs 621 of the abutment portion 62 of the clamping cover 60 and the sealing member 50 will be slightly compressed by the slide piece 40 to slightly deform, as shown in FIG. 7. As discussed above, the sealing member 50 can be provided with less thickness because the toner cartridge 1 won't have any toner leaking problem when the clamping cover 60 is properly coupled to the end cap 30. As such, when the slide piece 40 is pushed by a relevant element of the image-forming apparatus, the slide piece 40, on which the sealing member 50 having a small thickness is attached, can smoothly slide from the sealed position to the opened position so as to enable the toner to be discharged out via the toner exit 12. Similarly, when the image-forming apparatus needs not be supplied with toner from the toner cartridge 1, the slide piece 40 can be driven to smoothly slide from the opened position to the sealed position, and the edge of the sealing member 50 won't be liable to be tilted or peeled up by the edge of the toner exit 12 when the slide piece 40 slides.

In other embodiments, the structure of the clamping cover 60 can be modified. For example, the coupling arm 64 may be provided with no operating tab 643. Under this circumstance, the user may directly pull the hook 641 outwardly to enable the hook 641 to be disengaged from the coupling portion 14 so as to dismantle the clamping cover 60 from the end cap 30. Further, an inner side of the coupling arm 64 may be provided with a notch, into which the coupling portion 14 extends, such that the clamping cover 60 can also be coupled with the end cap 30 properly. Under this circumstance, the hook 641 can be omitted. Alternately, the coupling portion 14 may be formed as a coupling hole, into which the hook 641 of the coupling arm 64 extends, such that the clamping cover 60 can also be coupled with the end cap 30 properly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner cartridge, comprising:

a housing having a bottom side with a toner exit, and two lateral sides with two coupling portions;

a slide piece disposed to the housing and slidably moveable between an opened position and a sealed position;

a sealing member disposed to the slide piece in a way that the sealing member blocks the toner exit of the housing when the slide piece stays at the sealed position; and a clamping cover having an abutment portion, and two coupling arms extending upwardly from two lateral sides of the abutment portion and engaged with the two coupling portions of the housing respectively, the abutment portion being abutted against the slide piece that stays at the sealed position in a way that the sealing member is compressed and deformed by the slide piece.

2. The toner cartridge as claimed in claim 1, wherein each of the two coupling arms is provided at a top end thereof with a hook engaged with one of the coupling portions of the housing.

3. The toner cartridge as claimed in claim 2, wherein each of the two coupling arms has an operating tab extending downwardly.

4. The toner cartridge as claimed in claim 1, wherein the housing comprises a barrel provided at an end thereof with an opening, and an end cap disposed to the end of the barrel and blocking the opening of the barrel; the toner exit of the housing is provided at a bottom side of the end cap and the two coupling portions of the housing are provided at two lateral sides of the end cap.

5. The toner cartridge as claimed in claim 1, wherein the clamping cover further comprises a guard plate extending upwardly from the abutment portion and covering a terminal end of the housing.

6. The toner cartridge as claimed in claim 5, further comprising a control circuit board disposed to the terminal end of the housing.

7. The toner cartridge as claimed in claim 1, wherein the clamping cover is provided at a top side of the abutment portion with a plurality of ribs pressing on the slide piece.

8. The toner cartridge as claimed in claim 1, wherein the slide piece has a hollow portion, and the clamping cover is provided at a top side of the abutment portion with a positioning rib extending into the hollow portion of the slide piece.

9. The toner cartridge as claimed in claim 8, wherein the positioning rib of the clamping cover is abutted against a lateral side edge of the hollow portion of the slide piece.

10. The toner cartridge as claimed in claim 8, wherein the slide piece comprises a protrusion portion located by the hollow portion, and the abutment portion of the clamping cover has a through hole, into which the protrusion portion of the slide piece extends.

11. The toner cartridge as claimed in claim 1, wherein each of the two coupling portions of the housing is plate-shaped.

* * * * *